US008544639B2

(12) United States Patent
Yang et al.

(10) Patent No.: US 8,544,639 B2
(45) **Date of Patent: *Oct. 1, 2013**

(54) HOLDER FOR PORTABLE ELECTRONIC DEVICE BACKGROUND

(75) Inventors: Hsin-Yung Yang, New Taipei (TW); Li-Houng Lu, New Taipei (TW); Ching-Min Lin, New Taipei (TW); Tzu-Cheng Yu, Santa Clara, CA (US)

(73) Assignee: Chi Mei Communication Systems, Inc., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/459,530

(22) Filed: Apr. 30, 2012

(65) Prior Publication Data

US 2012/0211613 A1 Aug. 23, 2012

Related U.S. Application Data

(63) Continuation of application No. 13/082,546, filed on Apr. 8, 2011, now Pat. No. 8,393,464.

(30) Foreign Application Priority Data

Jan. 18, 2011 (TW) ..... 100101716 A

(51) Int. Cl.
*B65D 25/20* (2006.01)

(52) U.S. Cl.
USPC ..... 206/45.2; 206/320

(58) Field of Classification Search
USPC ..... 206/320, 576, 722, 724, 45.25, 45.2, 206/45.23, 45.24, 45.26, 767, 768, 45.28, 206/45.29, 754, 755, 760; 361/679.01; 312/223.2
See application file for complete search history.

(56) References Cited

U.S. PATENT DOCUMENTS

| | | | | |
|---|---|---|---|---|
| 5,607,054 | A | 3/1997 | Hollingsworth | |
| 6,763,942 | B1 | 7/2004 | Yeh | |
| 6,825,415 | B1 | 11/2004 | Chen et al. | |
| 6,829,140 | B2 | 12/2004 | Shimano et al. | |
| 6,871,739 | B2 * | 3/2005 | Lopez | 206/320 |
| 7,191,926 | B1 | 3/2007 | Costantino et al. | |
| 7,251,127 | B2 | 7/2007 | Ghosh et al. | |
| 7,333,327 | B1 * | 2/2008 | Ho et al. | 361/679.55 |
| 7,545,634 | B2 | 6/2009 | Simonian et al. | |
| 7,561,415 | B2 | 7/2009 | Liou et al. | |
| 7,748,528 | B2 * | 7/2010 | Anderson | 206/326 |
| 7,861,995 | B2 | 1/2011 | Liou | |
| 8,089,760 | B2 | 1/2012 | Yi-Chang | |
| 2004/0240164 | A1 * | 12/2004 | Lee | 361/683 |
| 2005/0067319 | A1 * | 3/2005 | Wei | 206/576 |
| 2006/0285283 | A1 * | 12/2006 | Simonian et al. | 361/679 |

(Continued)

OTHER PUBLICATIONS

Patently apple:"Apple's Ipad case Design is now Registered with Patent Office", Patentlyapple.com (Aug. 2, 2010).

(Continued)

*Primary Examiner* — Jacob K Ackun
*Assistant Examiner* — Jenine Pagan
(74) *Attorney, Agent, or Firm* — Altis & Wispro Law Group, Inc.

(57) ABSTRACT

A foldable holder includes a foldable cover, a supporting assembly attached to the cover. When the holder is unfolded, the supporting assembly is maintained in a substantially planar form. When the holder is folded, the supporting assembly form a three-dimensional structure that will not collapse under a weight.

12 Claims, 6 Drawing Sheets

(56) References Cited

U.S. PATENT DOCUMENTS

| | | | |
|---|---|---|---|
| 2008/0237432 | A1 | 10/2008 | Patterson |
| 2010/0122924 | A1 | 5/2010 | Andrews |
| 2010/0300909 | A1 | 12/2010 | Hung |
| 2011/0134590 | A1 | 6/2011 | Clark et al. |
| 2011/0180682 | A1 | 7/2011 | Tarnutzer et al. |
| 2011/0203955 | A1 | 8/2011 | Fasula |
| 2011/0259788 | A1 | 10/2011 | Zeliff et al. |
| 2011/0284420 | A1 | 11/2011 | Sajid |
| 2011/0285258 | A1 | 11/2011 | Yuan |
| 2011/0286171 | A1 | 11/2011 | Franz et al. |
| 2011/0297564 | A1 | 12/2011 | Kim et al. |
| 2011/0297566 | A1 | 12/2011 | Gallagher et al. |
| 2012/0248277 | A1* | 10/2012 | Yang et al. ..... 248/346.3 |

OTHER PUBLICATIONS

Squirrel, "Origami Ipad Sleeve From Incase," Gaygadget (Nov. 4, 2010).

* cited by examiner

HOLDER FOR PORTABLE ELECTRONIC DEVICE BACKGROUND

CROSS-REFERENCE TO RELATED APPLICATIONS

This application is a continuation application of U.S. Ser. No. 13/082,546, filed Apr. 8, 2011, the contents of which are hereby incorporated by reference. The patent application Ser. No. 13/082,546 in turn claims the benefit of priority under 35 USC 119 from Taiwan Patent Application 100101716, filed on Jan. 18, 2011.

This application is also related to co-pending U.S. patent applications as the following listed. Such applications have the same assignee as the present application, and are incorporated herein by reference.

| Ser. No. | Title | Inventors |
|---|---|---|
| 29/386,290 | MULTIFUNCTIONAL CASE FOR PORTABLE ELECTRONIC DEVICE | Lu et al. |
| 13/036,116 | MULTIFUNCTIONAL CASE FOR PORTABLE ELECTRONIC DEVICE | Lu et al. |
| 29/408,942 | PROTECTING CASE FOR PORTABLE ELECTRONIC DEVICE | Yang et al. |
| N/A | HOLDER FOR PORTABLE ELECTRONIC DEVICE | Lu et al. |

TECHNICAL FIELD

This disclosure relates to cases for portable electronic devices, particularly, to a holder for protecting and supporting portable electronic devices.

On one hand, cases are widely applied to protect portable electronic devices. On the other hand, users generally need a holder for supporting the portable electronic device, for example to read an eBook or watch video. However, it can be difficult to carry the case and the holder at the same time. In many cases, the holder can be easily left behind after use.

Therefore, there is room for improvement within the art.

BRIEF DESCRIPTION OF THE DRAWINGS

Many aspects of the holder can be better understood with reference to the following drawings. The components in the drawings are not necessarily drawn to scale, the emphasis instead being placed upon clearly illustrating the principles of the holder.

DETAILED DESCRIPTION

Figure 1:
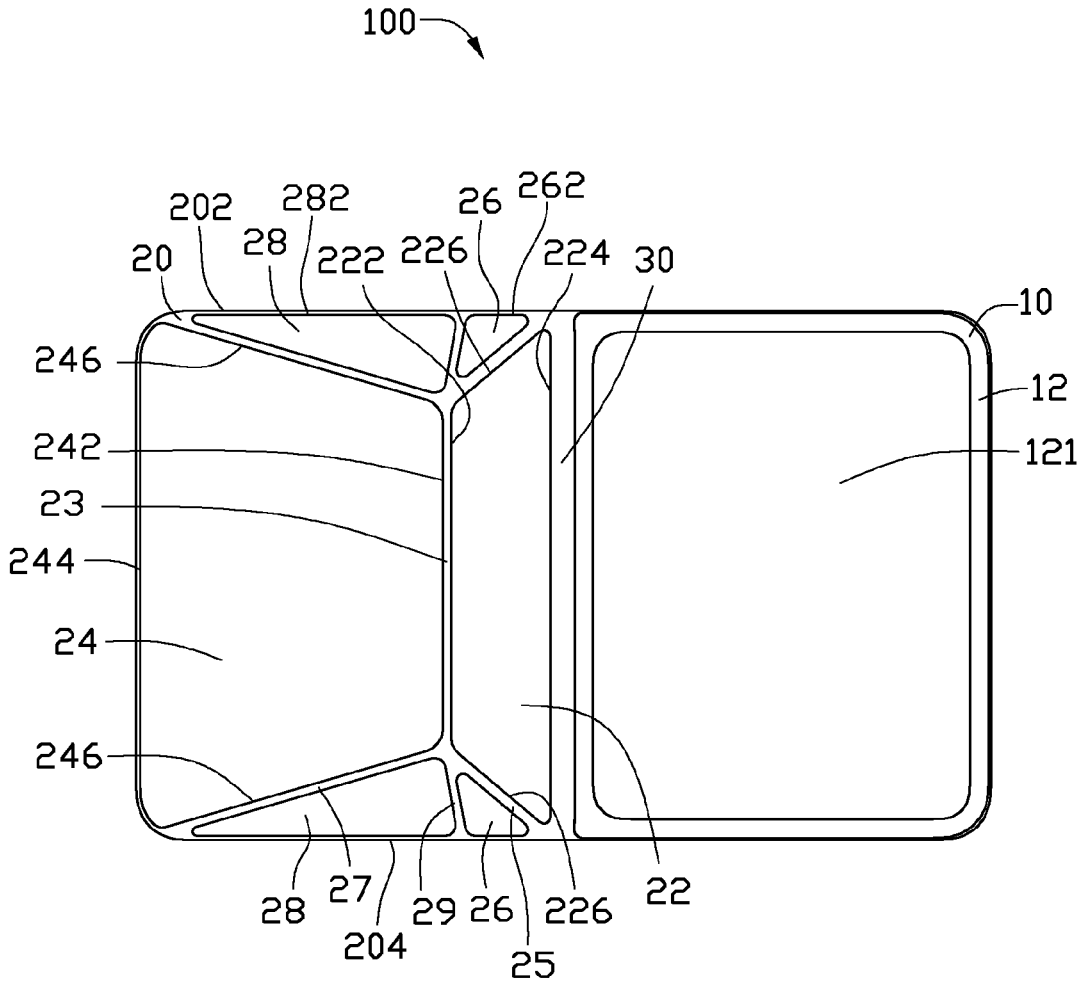
FIG. 1 is a frontal view of an unfolded holder as disclosed.

FIG. 1 shows an unfolded holder 100 for receiving and supporting an electronic device with flat-panel shaped structures such as a tablet computer, liquid crystal display television (LCD-TV), etc. The holder 100 includes a base 10, a cover 20 foldable relative to the base 10, and a connecting area 30 connecting the base 10 with the cover 20.

Figure 2:
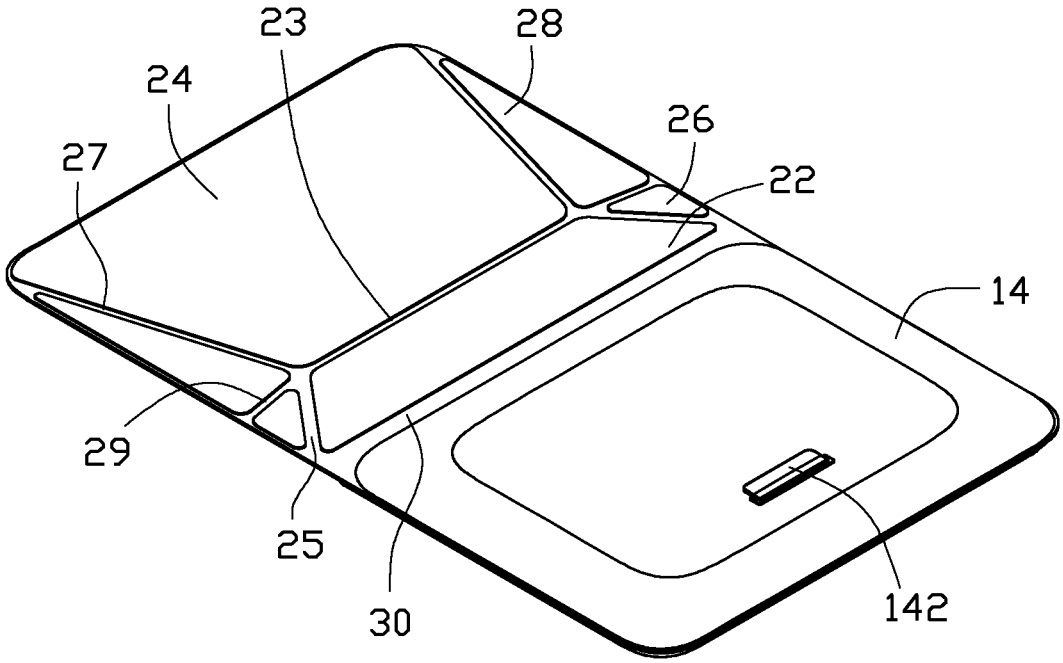
FIG. 2 is a back view of the unfolded holder shown in FIG. 1.

The base 10 defines a receiving space 121 in a front surface 12. The receiving space 121 receives the electronic device. Referring to FIG. 2, the base 10 forms a latching portion 142 such as a latching piece on a back surface 14 of the base 10. The latching portion 142, located near the middle of the back surface 14 and parallel with the connecting area 30, is elastic for easy latching of the cover 20.

The cover 20 has substantially the same size as the base 10. The cover 20 can rotate around the connecting area 30 to cover the base 10. The cover 20 includes a first plate portion 22, a second plate portion 24, two third plate portions 26, and two fourth plate portions 28. The cover 20 further has first and second opposite cover edges 202, 204. The first-fourth plate portions 22, 24, 26, 28 can be made of plastic materials such as polycarbonate. The first plate portion 22 and the second plate portion 24 are isosceles trapezoid shaped and have a first folding area 23 between them. The first plate portion 22 can be folded with respect to the second portion 24 along the first folding area 23. The first plate portion 22 has an upper margin 222, and a bottom margin 224 parallel with the upper margin 222. The upper margin 222 is adjacent to a side of the first folding area 23, and the bottom margin 224 is adjacent to a side of the connecting area 30.

The second plate portion 24 has an upper edge 242, and a bottom edge 244 parallel to the upper edge 242. The upper edge 242 is adjacent to the side of the first folding area 23 opposite to the upper margin 222. The bottom edge 244 is adjacent to the outer side of the cover 24.

Each third plate portion 26 is triangular and located at a side of the first plate portion 22. Each third plate portion 26 forms a second folding area 25 connecting to the first plate portion 22. The third plate portion 26 can be folded with respect to the first plate portion 22 along the second folding area 25. Each of the third plate portions 26 has a first edge 262.

Each fourth plate portion 28 is also triangular and located at a side of the second plate portion 24. Each fourth plate portion 28 forms a third folding area 27 connecting to the second plate portion 24. The fourth plate portion 28 can be folded relative to the second plate portion 24 along the third folding area 27. Each fourth plate portion 28 forms a fourth folding area 29 connecting to the third plate portion 26. The fourth plate portion 28 can be folded relative to the corresponding third plate portion 26 along the fourth folding area 29. Each fourth plate portion 28 has a second edge 282. The first edge 282 aligns with the second edge 262 and is parallel with one of the first and second cover edges 202, 204.

The connecting area 30 can be made from fibrous materials and/or plastic materials such as polyurethane. The folding areas 23, 25, 27, 29 can be made from the same materials as the connecting area 30. A supporting assembly includes the first plate portion 22, the second plate portion 24, the two third plate portions 26 and the two fourth plate portions 28. Though the first plate portion 22, the second plate portion 24, the two third plate portions 26, and the two fourth plate portions 28 can folded relative to each other. The first plate portion 22, the second plate portion 24, the third plate portions 26 and the fourth plate portions 28 are rigid and cannot be folded themselves. The supporting assembly is maintained in a substantially planar form when the holder 100 is unfolded flat for protecting the portable electronic device 40. When the holder is folded, the supporting assembly forms a three-dimensional structure that will not collapse under a weight of the portable electronic device. When forming the three-dimensional structure, the fold angles between the first plate portion 22, second plate portion 24, third plate portions 26, and fourth plate portions 28 cooperate to prevent the three-dimensional structure from collapsing under a weight, such as that of a portable electronic device. The cover 20 can cover and protect the base 10 when received in the receiving space 121, while the first plate portion 22, the second plate portion 24, the two third plate portions 26, and the two fourth plate portions 28 are unfolded relative to each other.

Figure 3:
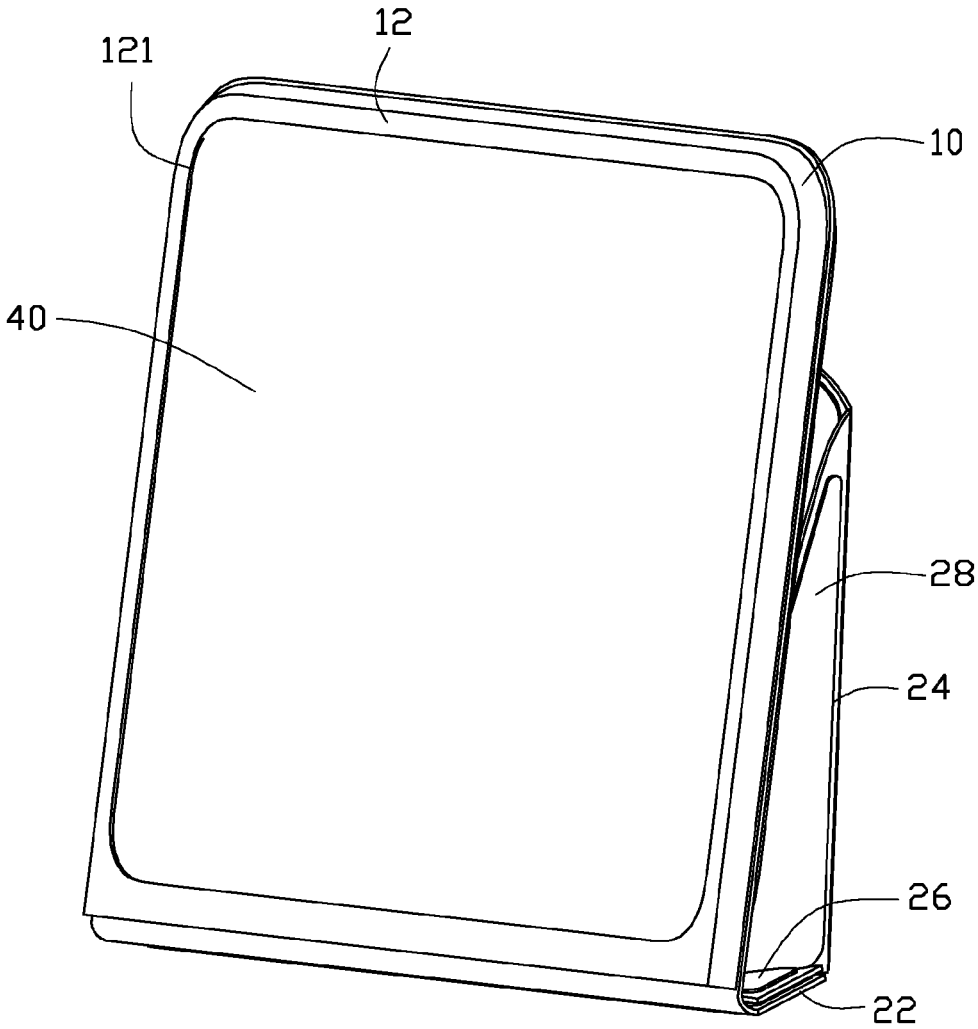
FIG. 3 is a front view when the holder is folded for the purpose of receiving and supporting an electronic device for viewing.
Figure 4:
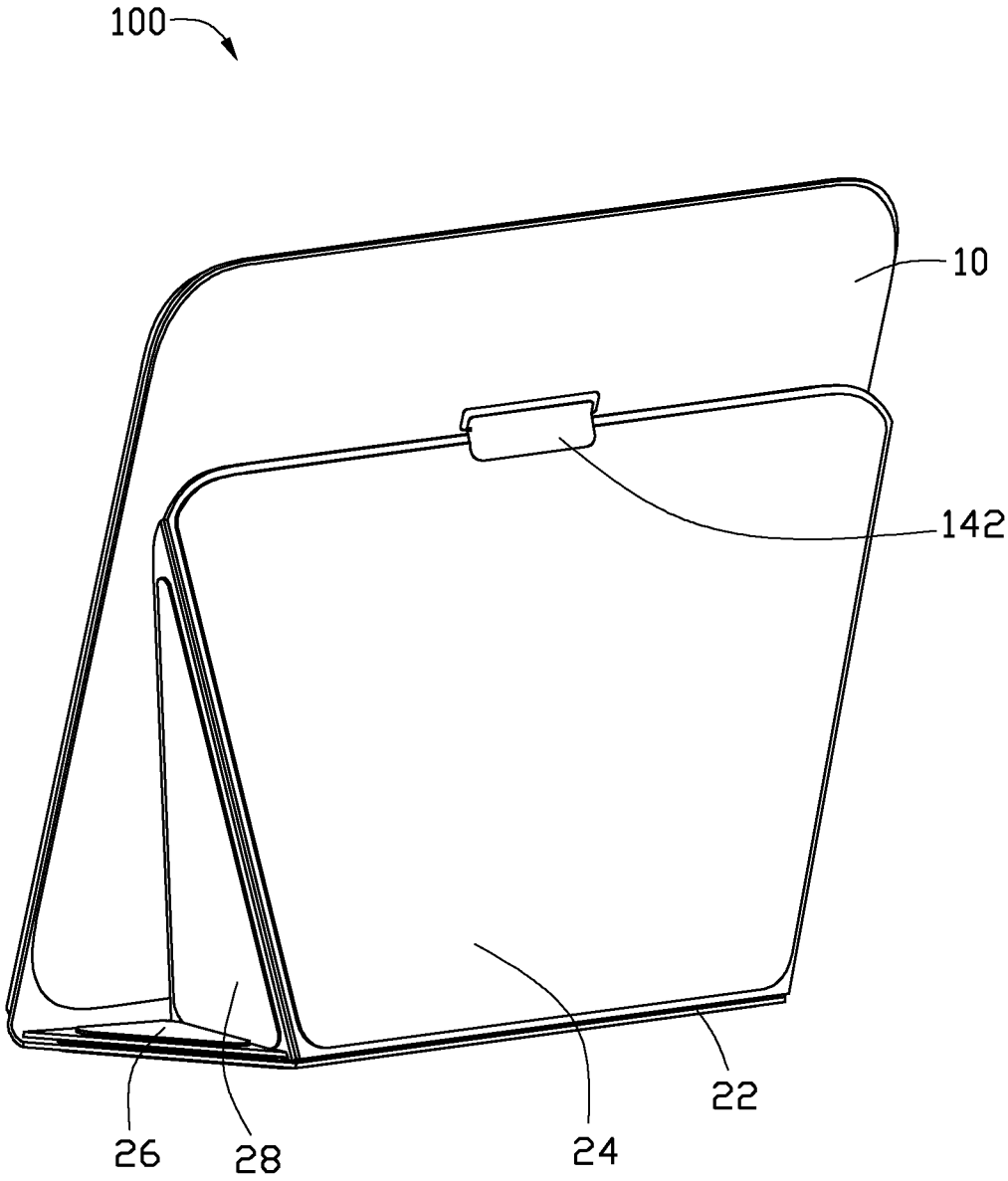
FIG. 4 is a back view of FIG. 3.

Referring to FIGS. 3 and 4, for achieving an oblique angle of view for a received electronic device 40, the cover 20 is folded and the first plate portion 22, the second plate portion 24, the third plate portions 26, and the fourth plate portions 28 cooperatively form a three-dimensional structure that supports the portable electronic device 40 at an angle relative to the cover 20. The cover 20 can be opened relative to the base 10 and further folded to cause the first plate portion 22 to fold towards the back surface 14 of the base 10 along the connecting area 30. The second plate portion 24 folds relative to the first plate portion 22 along the first folding area 23 until the outer side of the cover 20 latches to the latching portion 142. Each third plate portion 26 is folded towards the first plate portion 22 along the second folding area 25 and abuts against the first plate portion 22. Each fourth plate portion 28 is folded towards the second plate portion 24 along the third folding area 27. Thus, the third plate portions 26 and the fourth plate portions 28 cooperatively support the second plate portion 24. The third plate portions 26 are non-perpendicularly supported by the first plate portion 22. Each third plate portion 26 directly and entirely contacts and covers the first plate portion 22. The second plate portion 24 rests against the back surface 14 of the base 10, and the base 10 can stand steadily on a platform (not shown) in an angled orientation. In this angled orientation, the electronic device 40 can be viewed comfortably.

Figure 5:
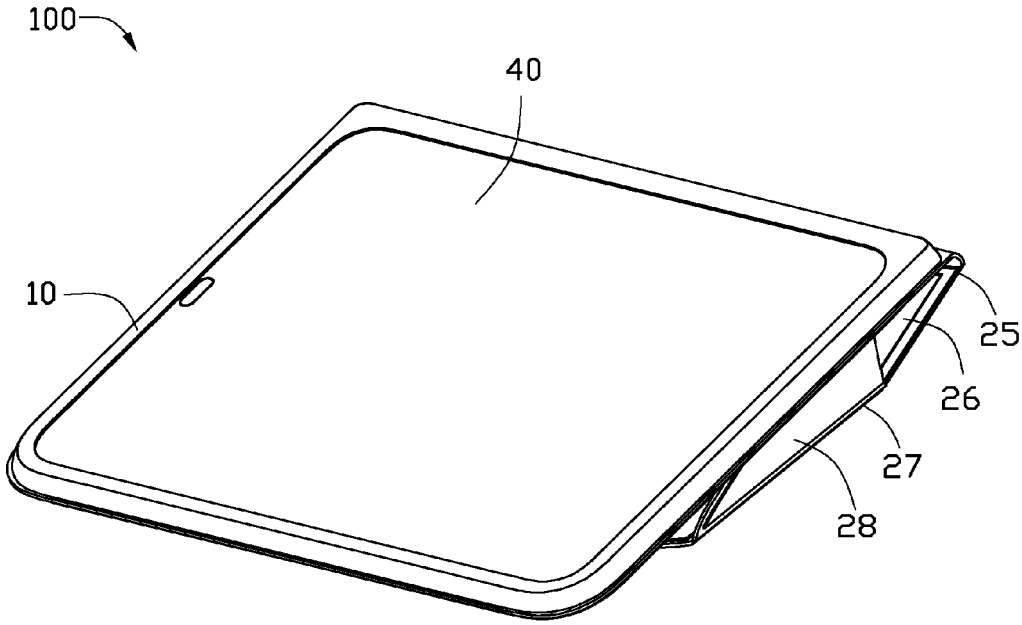
FIG. 5 is a schematic view when the holder is placed in a position for supporting the electronic device.

FIG. 5 shows an orientation where the first plate portion 22 is lowered towards the platform and the third folding area 27 steadily rests against and on the platform. At this orientation, the display 42 of the electronic device 40 can be used more comfortably.

Figure 6:
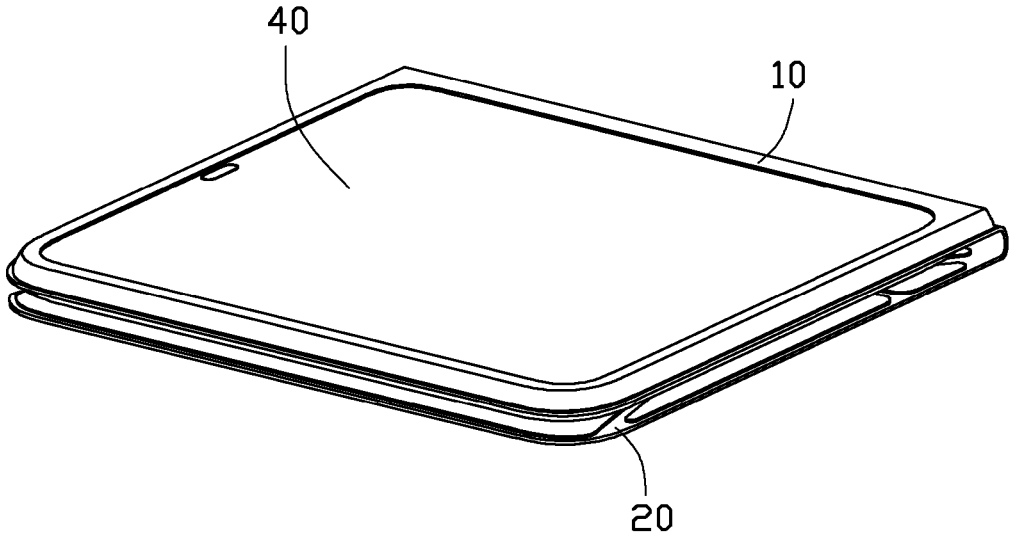
FIG. 6 is a substantially folded view of the holder with the electronic device exposed.

FIG. 6 shows an orientation when the cover 20 is opened and parallel to the base 10. The electronic device 40, if received in the receiving space 121, is exposed to the outside for viewing. Meanwhile, the first plate portion 22, the second plate portion 24, the two third plate portions 26, and the two fourth plate portions 28 are maintained unfolded.

It is to be understood that even though numerous characteristics and advantages of the present exemplary embodiments have been set forth in the foregoing description, together with details of structures and functions of various embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A foldable holder for holding and supporting a portable electronic device, comprising:

a base defining a receiving space in a front surface for receiving the electronic device and having a latching portion on a back surface;

a cover having first and second opposite cover edges; the cover comprising:

a first plate portion;

a second plate portion;

two third plate portions, each of the third plate portions having a first edge;

two fourth plate portions, each of the fourth plate portions having a second edge; and the two fourth plate portions and the third plate portions positioned at two sides of the second plate portion, the first edge aligning with the second edge and parallel with one of the first and second cover edges;

wherein, when folded, the first plate portion, the second plate portion, the third plate portions, and the fourth plate portions cooperatively form a three-dimensional structure, with the second plate portion held between the latching portion and the back surface of the base that can support the portable electronic device at an angle relative to the cover without collapsing.

2. The foldable holder as claimed in claim 1, wherein when folded, the second plate portion is angled with the first plate portion, the third plate portions are non-perpendicularly supported by the first plate portion, and each of the fourth plate portions is angled with the third plate portions and the second plate portion, the fourth plate portions and the first plate portions are angled to support the support the portable electronic device in an angled position.

3. The foldable holder as claimed in claim 2, wherein each of the fourth plate portions stands on the first plate portion, retaining the second plate portion at an acute angle relative to the first plate portion.

4. The foldable holder as claimed in claim 1, further comprising: a connecting area connecting the base and the cover, the cover foldable relative to the base around the connecting area.

5. The foldable holder as claimed in claim 1, wherein the first plate portion, the second plate portion, the two fourth plate portions, and the two third plate portions are positioned apart from each other and foldable relative to each other, the first plate portion and the second plate portion defines a first folding area therebetween, the two third plate portions and the first plate portion define two opposite second folding areas therebetween, the two fourth plate portions and the second plate portion defines two opposite third folding areas therebetween, and the third plate portions and the fourth plate portions defines two opposite fourth folding areas therebetween.

6. A foldable holder for holding and supporting a portable electronic device, comprising:

a base defining a receiving space in a front surface for receiving the electronic device and having a latching portion on a back surface;

a connecting area;

a foldable cover connecting the base with the connecting area;

wherein, when the holder is unfolded, the cover faces the front surface of the base and the portable electronic device is covered by the cover, the portable electronic device can be held by the foldable holder at a position abutting the connecting area;

when the holder is folded by folding the cover, the cover is folded around the connecting area to face the back surface of the base to expose the electronic device for use from the front surface and the cover is held between the latching portion and the back surface of the base, the position of the portable electronic device relative to the connecting area is maintained, and the portable electronic device can be simultaneously supported by the cover in an angled orientation.

7. The foldable holder as claimed in claim 6, wherein the cover comprises a first plate portion, a second plate portion, two fourth plate portions, and two third plate portions, the two fourth plate portions are positioned at two opposite sides of the second plate portion, each of the third plate portions is positioned between the corresponding one fourth plate portion and the first plate portion, the second plate portion, the two fourth plate portions and the two third plate portions configured to fold towards the first plate portion, the third plate portions are non-perpendicularly supported by the first plate portion when the portable electronic device is supported in the angled position.

8. The foldable holder as claimed in claim 7, wherein:

the first plate portion and the second plate portion has a first folding area between them, the first plate portion can be folded relative to the second portion along the first folding area;

each third plate portions forms a second folding area connecting to the first plate portion, and the third plate portions can be folded relative to the first plate portion along the second folding area;

each fourth plate portion forms a third folding area with the second plate portion, and the fourth plate portion can be folded relative to the second plate portion along the third folding area;

each fourth plate portion forms a fourth folding area with a corresponding third plate portion, and the fourth plate portion can be folded relative to the corresponding third plate portion along the fourth folding area.

9. The foldable holder as claimed in claim 8, wherein the first plate portion has an upper margin and a bottom margin parallel with the upper margin, the upper margin is adjacent to a side of the first folding area and the bottom margin is adjacent to a side of the connecting area.

10. The foldable holder as claimed in claim 8, wherein the second plate portion has an upper edge and a bottom edge parallel with the upper edge, the upper edge is adjacent to the side of the first folding area opposite to the upper margin, the bottom edge has the same length with the connecting area and is located at a side of the cover.

11. The foldable holder as claimed in claim 7, wherein the second plate portion and the first plate portion are isosceles trapezoid shaped, the two third plate portions are triangular, and the two fourth plate portions are triangular.

12. The foldable holder as claimed in claim 7, wherein the each of the fourth plate portions stands on the first plate portion, retaining the second plate portion at an acute angle relative to the first plate portion.

* * * * *